United States Patent [19]

Robertson

[11] Patent Number: 4,893,562

[45] **Date of Patent: * Jan. 16, 1990**

[54] BEARER WIPER ASSEMBLY

[75] Inventor: Albert W. Robertson, Christopher, Ill.

[73] Assignee: Air Stamping, Inc., Christopher, Ill.

[ * ] Notice: The portion of the term of this patent subsequent to Nov. 10, 2001 has been disclaimed.

[21] Appl. No.: 118,659

[22] Filed: Nov. 9, 1987

Related U.S. Application Data

[63] Continuation of Ser. No. 827,755, Feb. 7, 1986, Pat. No. 4,704,964.

[51] Int. Cl.[4] ..... B41F 35/02

[52] U.S. Cl. ..... 101/425

[58] Field of Search ..... 15/256.51; 101/425

[56] References Cited

U.S. PATENT DOCUMENTS

| | | | |
|---|---|---|---|
| 263,387 | 8/1882 | Cheney | 15/221 |
| 429,381 | 6/1890 | Harvey | 15/256.51 |
| 488,455 | 12/1892 | Scallen | 15/256.51 |
| 700,133 | 5/1902 | Connelly | 15/256.51 |
| 1,092,535 | 4/1914 | McClintock | 15/221 |
| 1,415,859 | 5/1922 | Bates | 15/256.51 |
| 1,797,290 | 3/1931 | Kutter | 15/256.51 |
| 2,403,434 | 7/1946 | Gulden | 15/256.51 |
| 2,428,224 | 9/1947 | Johnson | 15/256.51 |
| 2,445,135 | 7/1948 | Curtis | 15/256.51 |
| 2,525,982 | 10/1950 | Wescott | 101/425 |
| 2,551,601 | 5/1951 | Hughson | 101/425 |
| 3,327,341 | 6/1967 | Kuehn | 15/256.51 |
| 3,626,833 | 12/1971 | Koch | 15/256.51 |
| 3,656,431 | 4/1972 | Giori | 101/425 |
| 3,807,853 | 4/1974 | Hudson | 101/425 |
| 3,822,642 | 7/1974 | Grindeland | 15/256.51 |
| 3,850,099 | 11/1974 | Laben | 15/256.51 |
| 3,952,654 | 4/1976 | Evans | 101/425 |
| 4,151,797 | 5/1979 | Dunsirn | 15/256.51 |
| 4,236,450 | 12/1980 | Bonomi | 101/425 |
| 4,311,094 | 1/1982 | Ellison | 101/425 |
| 4,411,042 | 10/1983 | Sakata | 15/256.51 |
| 4,449,825 | 2/1985 | Uno | 101/107 |
| 4,509,225 | 4/1985 | Haugen | 15/256.51 |
| 4,704,964 | 11/1987 | Robertson | 101/425 |

FOREIGN PATENT DOCUMENTS

| | | | |
|---|---|---|---|
| 2925201 | 1/1981 | Fed. Rep. of Germany | 101/425 |
| 1342436 | 9/1963 | France | 15/221 |

*Primary Examiner*—Clifford D. Crowder

*Attorney, Agent, or Firm*—Cohn, Powell & Hind

[57] ABSTRACT

This bearer wiper assembly (10, 12) includes independent extensible arms in the form of pneumatic rams (28) provided for each printing press bearer (14, 16). The pneumatic rams (28) are pivotally mounted to a support bracket (22) in swing-away relation and a bearer wiper unit (70) is provided at the remote end of each ram. The rams are releasably held in place by a latching mechanism (48, 60) and each wiper unit (70) includes by an ell-shaped pad (72) releasably clamped to a mounting frame (76) carried by each ram (28). The bearer-engageable portion (98) of each pad (72) is apertured to collect foreign particulate matter from the bearers (14, 16).

7 Claims, 2 Drawing Sheets

FIG. 1.
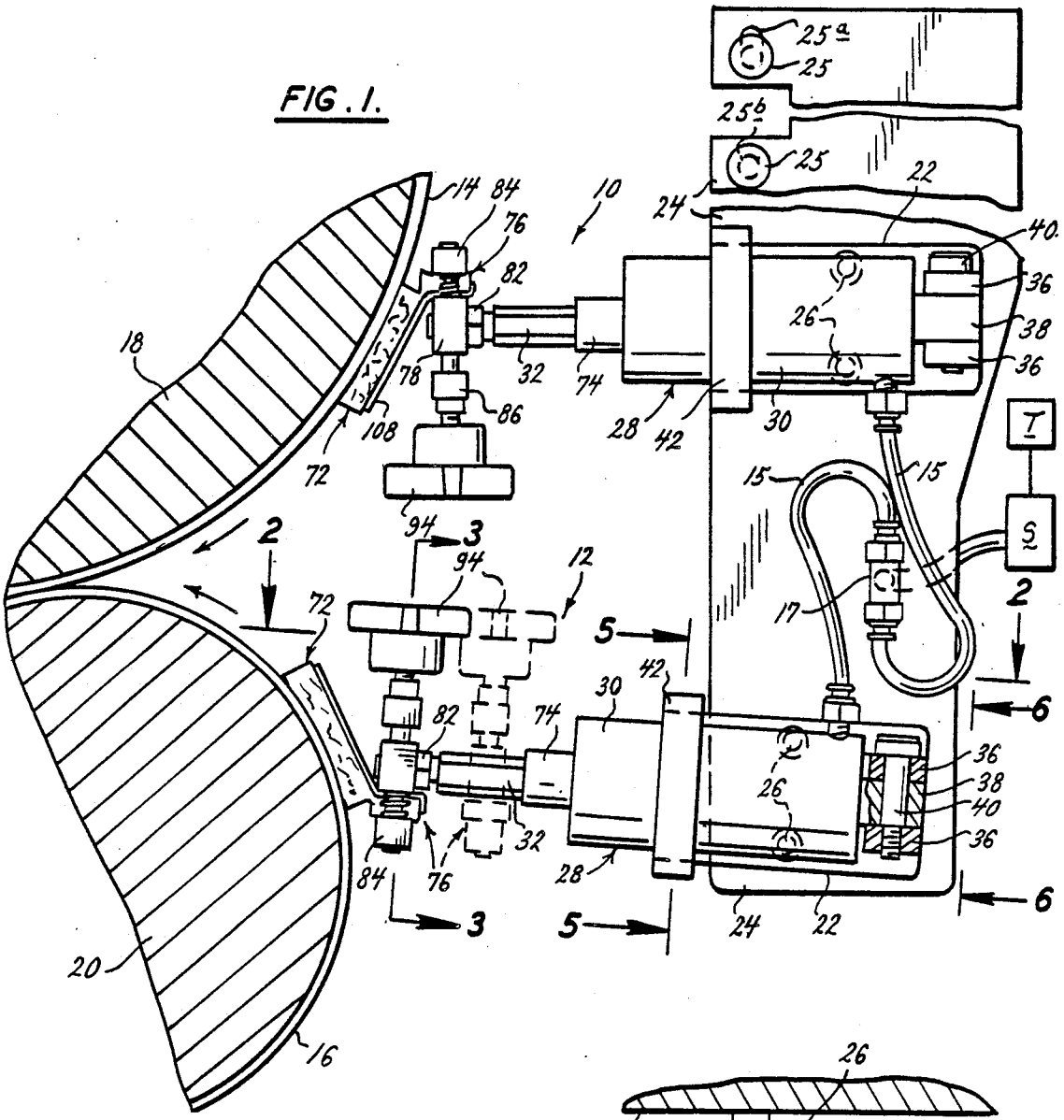
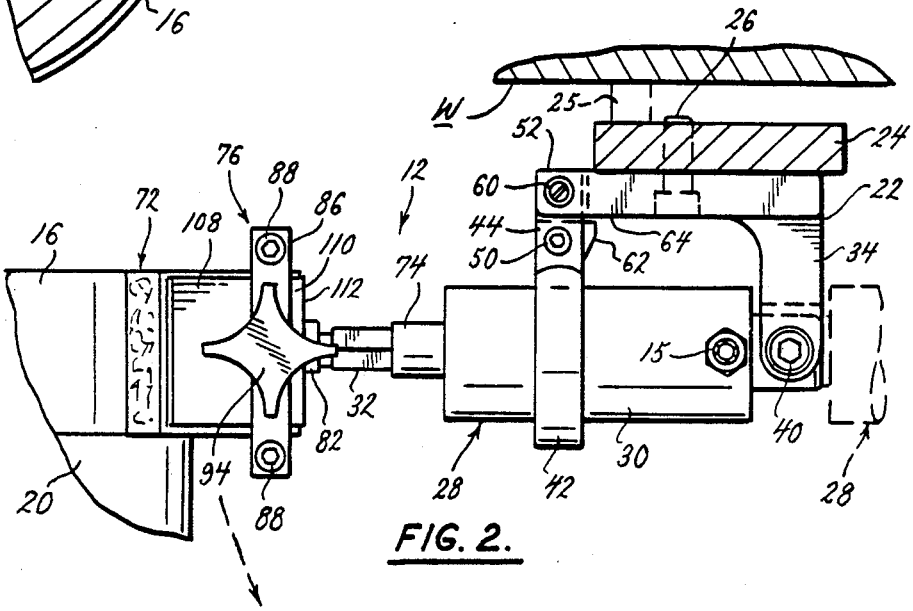
FIG. 2.

BEARER WIPER ASSEMBLY

This is a continuation of Ser. No. 827,755, filed on Feb. 7, 1986, now U.S. Pat. No. 4,704,964.

BACKGROUND OF THE INVENTION

This invention relates generally to wiper assemblies for the bearers of printing press rolls and more particularly to an improved wiper assembly mounted to an extended arm for controlled bearer engagement.

Printing press rolls are provided, at each end, with cylindrical bearers which directly engage each other and have substantially fixed parallel axes of rotation.

The conventional method of cleaning such bearers is by the application of a felt pad to the surface of the bearers, the pad being held in constant engagement with the bearers during rotation of the printing rolls. This is an unsatisfactory arrangement for several reasons. The most important of these results from the fact that such a constant contact system generates a considerable amount of heat. This heat causes the bearers to expand diametrically and, because of the fixed axes, the growth of the bearers increases the load on the bearers which compounds the heat generation problem and can result in bearing fatigue. Another result of bearer growth due to heat generation is that additional power is required to drive the system resulting in higher energy costs and transmission wear.

In addition to the above, when the bearers experience diametrical growth there is a tendency for the printing cylinders to be forced apart causing dot deterioration and a corresponding deterioration in print quality.

Heat generation in the bearers also causes heat generation in the cylinders resulting in undue water evaporation resulting in an undesirable condition known as scumming which also lowers print quality.

Another problem resulting from providing constant contact bearer wipers is that when the presses are at rest the wipers are engaged for extended periods against the bearer surface which is conducive to bearer corrosion.

The prior art reveals that attempts have been made to correct the above problems but the proposed solutions are evidently either ineffective or expensive since the constant contact wiper is still widely used. Of the known prior patents the following are of interest. U.S. Pat. No. 4,015,307 discloses a housing carrying a rotatable absorbent wiper roller which is moved hydraulically into engagement with a cylindrical surface. U.S. Pat No. 4,162,652 discloses a spring-loaded and hinged sponge and scraper assembly. U.S. Pat. No. 3,822,642 discloses a pivotally mounted scraper which is moved into engagement with a bearing surface hydraulically.

The present bearer wiper assembly solves the problems outlined above in a manner not revealed by the known prior art.

SUMMARY OF THE INVENTION

This invention provides a printing press bearer wiper assembly which significantly reduces heat generation in the system with a consequent reduction in bearer fatigue, bearer corrosion and transmission wear and also results in an improvement in printing roll picture quality by reducing heat transfer to the printing rolls.

The improvements are the result of providing an assembly which does not rely on a constant contact bearer wiper but provides instead a bearer wiper assembly which can readily be moved out of engagement with the bearer both during operation of the press and when the press is at rest.

Movement of the bearer wiper assembly out of engagement during operation results in reduced heat generation thereby reducing the tendency of the bearers to experience diametrical growth and such heat generation is further reduced by selective control of the bearer wiper pressure. Movement of the bearer wiper assembly out of engagement when the press is at rest results in a reduction in the corrosion which occurs when wiper pads, carrying corrosive chemicals used in the printing presses, are held in place against the bearers for an extended period.

The provision of a bearer wiper assembly which can easily be swung away out of engagement with the bearers permits rapid replacement of the wiper pads. Further, the provision of apertured bearer wiper pads improves the removal and collection of particulate foreign matter from the bearer surface.

It is an aspect of this invention to provide a wiper assembly for a printing apparatus having rotatable bearer members, the wiper assembly including a support means; an extensible arm having a remote end; a bearer-engageable wiper means removably attached to the remote end of the arm and pivot means operatively mounting the extensible arm to the support means in swing-away relation.

It is another aspect of this invention that the extensible arm is provided by a cylinder and piston so that the wiper means is carried by the piston and can be withdrawn from the engagement with the bearer during rest periods, and which can also be pressure-controlled during bearer engagement.

Yet another aspect of this invention is to provide holding means between the cylinder and the support means to hold the piston in aligned relation during the wiping operation and yet another aspect of this invention to provide that the holding means includes cooperating detent portions provided on the cylinder and the support means so that the cylinder is manually releasably latched to the support means.

Another aspect of this invention is to provide that the holding means includes a collar mounted to the cylinder and having an outstanding portion engageable with the cooperating portion of the support means.

Still another aspect of this invention is to provide that the wiper means includes a wiper pad having a bearing engageable portion including a plurality of collection apertures to facilitate the collection of particulate foreign matter from the bearer.

Yet another aspect of this invention is to provide that the wiper means includes a felt wiper pad having a forward bearer-engageable portion and a rearward mounting portion and to provide means for mounting the rearward portion of the pad to the remote end of the piston.

Yet another aspect of this invention is to provide that the wiper pad is generally ell-shaped and the wiper pad mounting means includes a backing plate conforming generally to the configuration of the wiping pad and a clamping frame attached to the remote end of the piston to facilitate clamping the backing plate and the wiper pad mounting portion to said piston.

In another aspect of this invention the clamping frame includes a cross member connected to the remote end of the piston, a member spaced from the cross member on one side thereof and receiving the mounting portion of the wiping pad and the backing plate therebetween and a clamping screw receiving member spaced from the cross member on the other side thereof and having a clamping screw operatively engageable with the cross member for moving the cross member into clamping engagement with the wiper pad and backing plate.

It is an aspect of this invention to provide a wiper pad having forward and rearward portions formed from a single pad provided with a transverse notch and including means for stiffening the pad so that it conforms to the desired ell-shaped configuration.

An aspect of this invention is to provide first and second wiper assemblies engaging first and second bearers, each assembly including a cylinder having a support bracket mounted to a wall plate, the cylinder being pivotally mounted to the bracket in swing-away relation about a pivot axis, and having a piston provided with a bearer-engageable wiper means removably attached to the remote end thereof, the first and second wiper assemblies being fluid-interconnected for simultaneous withdrawal from bearer engagement.

It is still another aspect of this invention to provide a bearer-engageable wiper assembly which is relatively inexpensive to manufacture, simple to operate and highly effective in use.

BRIEF DESCRIPTION OF THE DRAWINGS

FIG. 1 is an elevational view of upper and lower bearer wiper assemblies;

FIG. 2 is a plan view of the lower assembly taken on line 2—2 of FIG. 1;

DESCRIPTION OF THE PREFERRED EMBODIMENT

Figure 3:
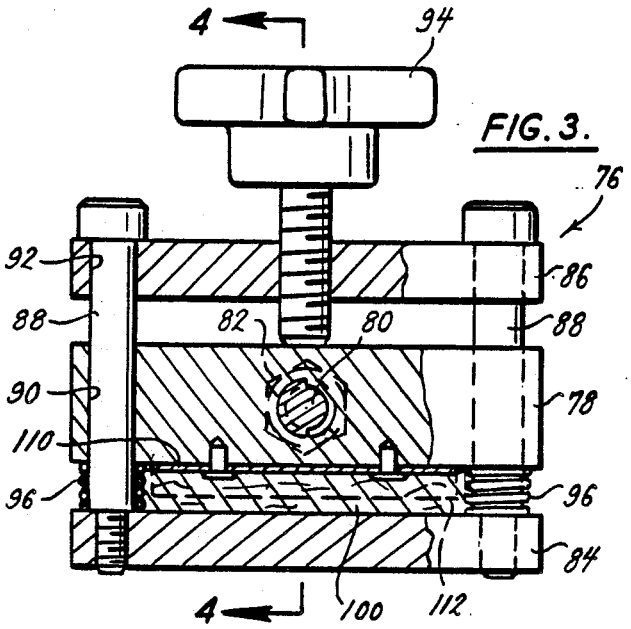
FIG. 3 is an enlarged cross sectional view taken on line 3—3 of FIG. 1 illustrating the lower wiper mounting frame.

Referring now by reference numerals to the drawings and first to FIGS. 1 and 2 it will be understood that upper and lower bearer wiper assemblies 10 and 12 are shown engageable with bearers 14 and 16, respectively, provided at the end of upper and lower printing press rolls 18 and 20 rotating in opposite directions as indicated by the arrows. It will be further understood that a similar set of bearers and bearer wiper assemblies are provided at the other end of said printing press rolls. The bearer wiper assemblies 10 and 12 are essentially identical, except for the reverse orientation of the wiper pads, and for this reason the assemblies will be described with reference to the lower assembly 12, it being understood that similar reference numerals indicate similar parts on each assembly.

As shown in FIGS. 1 and 2, the bearer wiper assembly 12 includes a support bracket 22 constituting a support means mounted to a wall plate 24 which is fixedly attached to a vertical wall W, as by spacer bolts. The upper spacer bolt 25 is received by a slot 25*a* and the lower bolt by a circular opening 25*b* which provides the wall plate 24 with adjustment capability. A pneumatic ram 28, consisting of a cylinder 30 and a piston 32, is pivotally mounted to the support bracket 24 in swing-away relation and the cylinders 30 of each assembly are pneumatically linked by air hose 15 supplied from a common supply connection 17 attached to a supply S controlled by a timer T.

Figure 6:
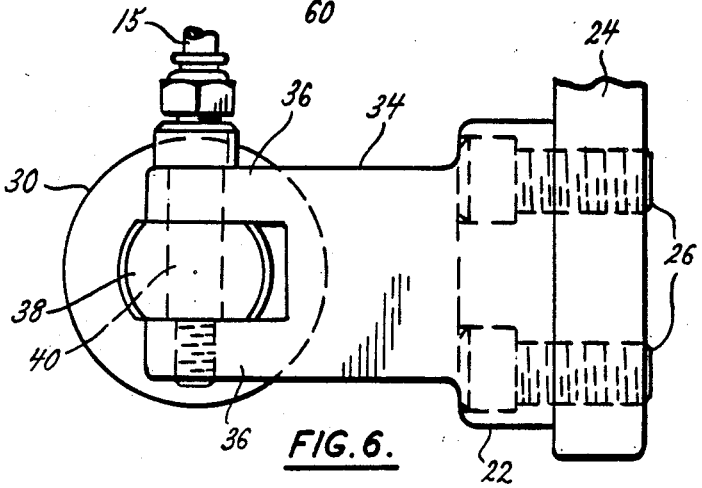
FIG. 6 is an enlarged end view of the lower cylinder.

To achieve the swing-away relation, as best shown in FIG. 6, the bracket 22 includes a bifurcated outstanding lug 34 providing a pair of spaced portions 36 and the ram cylinder 30 includes an end lug 38, which is pivotally connected to said spaced lugs by a pivot bolt 40. This arrangement permits the ram 28 to be swung through one hundred eighty degrees (180°) to the position shown in phantom outline in FIG. 2.

Figure 5:
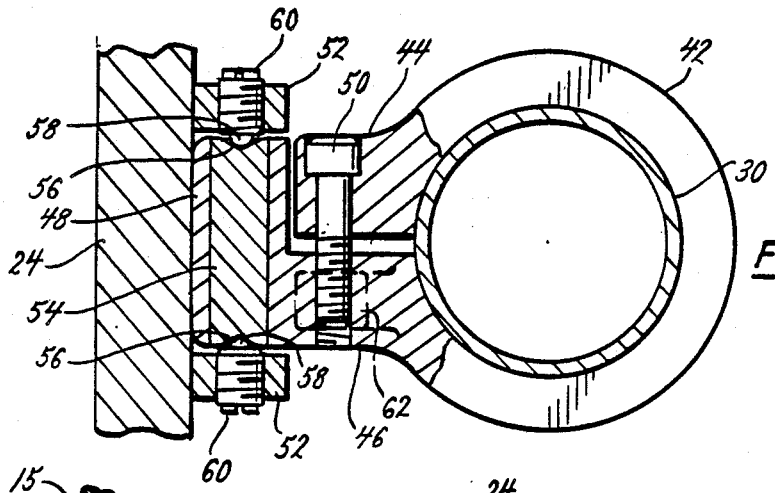
FIG. 5 is an enlarged cross sectional view taken on line 5—5 of FIG. 1 illustrating the lower cylinder holding collar.

In order to hold the ram 28 in proper alignment the cylinder 30 includes a latching means which cooperates with the support bracket 22 to hold the ram in place. The latching means is best shown in FIG. 5 and, as there shown, the cylinder 30 includes a collar 42 having spaced portions 44 and 46 and an end portion 48 unitarily formed with the lower end portion 46. The collar 42 is clamped to the cylinder 30 by a clamping bolt 50. The end portion 48, which is effectively integrally formed with the cylinder 30, by virtue of the clamping collar, is received between end lugs 52 provided on the support bracket 22. The end portion 48 includes a push fitted core 54 having contoured recesses 56 at each end which receive spring-loaded detent balls 58 provided in adjustable set screws 60 which are threadedly received in outstanding lugs 52. The screws 60 are set to a spring-loaded latching position such that the ram 28 is removed simply by tugging manually on the cylinder. The latching means includes a stop 62 which extends from the lower portion 46 of the collar 42, as shown in FIG. 2, and is engageable with an adjacent face 64 of the support bracket 22 to facilitate proper latching.

As clearly shown in FIGS. 1–4 a wiper unit, generally indicated by numeral 70, and including a bearer-engageable felt pad 72, is mounted to the remote end of the piston 32. As will be understood from FIG. 2 the piston 32 is non-circular, hexagonal in the embodiment shown, and is received in sliding relation within a compatibly apertured reduced end 74 of the cylinder to preclude rotation of said piston.

Figure 4:
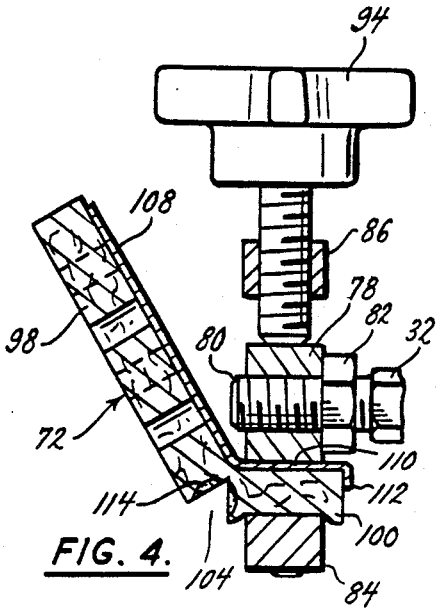
FIG. 4 is an enlarged longitudinal sectional view of said frame taken on line 4—4 of FIG. 3.

As best shown in FIGS. 3 and 4 the wiper unit 70 includes a clamping frame 76 consisting of a cross member 78 attached to the threaded end 80 of the piston 32 and held in place by a locknut 82. The frame 76 includes a cooperating members 84 and 86 spaced on opposite sides of the cross member 78. Member 84 is threaded to receive guide bolts 88, which receive cross member 78 and member 86 in sliding relation, said members being provided with apertures 90 and 92 respectively of a size to permit easy sliding.

As clearly shown in FIG. 3, the member 86 is apertured to receive a clamping screw 94 in threaded relation and compression springs 96 are provided on the bolts 88 between members 78 and 84 to provide a load bias acting in opposition to load exerted on the member 78 by the clamping screw 94. This arrangement provides a means of clamping the pad 72 securely in place.

Figure 7:
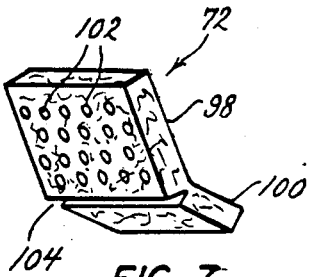
FIG. 7 is an enlarged perspective view of a wiper pad.

The pad 72 as best shown in FIGS. 4 and 7 includes a forward portion 98 and a rearward portion 100. The bearer-engageable forward portion 98 is provided with a plurality of collection openings 102 and, in the preferred embodiment about twenty (20) openings are provided and pad portion 98 has a thickness of about three-eighths inch ($\frac{3}{8}$") and a size of about two inches (2")

square. The openings are about three-sixteenth inch (3/16") diameter and extend completely through the pad. The wiper pad forward and rearward portions 98 and 100 are formed from a single pad, in the preferred embodiment, which is cut through about two-thirds of its thickness to provide a bend line notch 104. In order to stabilize the pad 72 a flexible, spring-steel backing plate 106 is provided having a generally ell-shaped configuration conforming to the configuration of the pad. As shown in FIG. 4, the backing plate includes a forward portion 108 and a rearward portion 110. The rearward portion 110 is fixedly attached to the cross member 78, as by rivets, and includes a lip 112 engageably by the rearward end of the pad 72. The ell-shaped configuration of the pad 72 is maintained by glue spots 114 injected into the felt in the notch 104 which effectively provides stiffening elements.

It is thought that the structural features and functional advantages of this bearer wiper assembly have become fully apparent from the foregoing description of parts but for completeness of disclosure the operation of the assembly will be briefly described.

Two bearer wiper assemblies 10 and 12 are provided, one for each end bearer 14 and 16 respectively, said assemblies being pneumatically linked as by the air hose 15 to a common air supply connection 17 so that the pistons 32 of each assembly are extended or retracted simultaneously.

The assemblies 10 and 12 are accurately mounted to the wall plate 24 so that the bearer-engageable pads 72, in the extended position, are substantially tangentially applied to the bearers the flexible backing plate forward portion 108 having some give and being self-aligning to some extent. During rest periods, when the printing rolls 18 and 20 are not operating, the pistons 32 are retracted so that the pads 72 are withdrawn from engagement with the bearers 14 and 16 with the result that corrosion from chemicals on the pad is obviated or minimized. As will readily be understood the pads 72 can also be withdrawn from engagement with the bearers for extended periods during printing if desired.

During bearer engagement, the pads 72 collect particulate foreign matter in the openings 102 with the result that the life of the pads is extended. When it becomes necessary to replace a pad 72, it is a simple matter to swing the ram 28, in the withdrawn position, in the direction shown by the arrow in FIG. 2 and through one-hundred and eighty degrees (180° that the mounting frame 76 is readily accessible. In this position, the clamping screw 94 can readily be rotated to relieve the clamping action, and the ell-shaped pad removed. The backing plate 106 provides a guide means facilitating the proper orientation of the pad 72.

The use of common air supply S controlled by a timer T, or in some cases by a computer (not shown) permits control of the movement of the wiper units intermittently into and out of engagement with the bearers. This arrangement considerably decreases the generation of heat. For example, in a typical operational situation the engagement can be ten (10) minutes off and thirty (30) seconds on. Such relatively light, though effective, use of the wiper units is believed to result in a 30° F. temperature differential. Since, with some bearers it is estimated that each 5° F. of temperature produces a bearer load increase of up to two hundred fifty (250) pounds, it is clear that significant improvements in operation in the context of heat generation are possible.

Further, by providing multiple bearer wiper pad openings not only is particulate matter readily collected but the cleaning efficiency of the pad is much increased due to the increased cleaning edges or margins available.

In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

I claim as my invention:

1. In a printing apparatus having rotatable bearer members, a bearer wiper assembly comprising:

(a) a support means, (b) an extensible arm having opposed ends one of said ends being attached to the support means, (c) a wiper means removably attached to the extensible arm, said wiper means including a wiper pad having a direct bearer-engageable portion provided with a plurality of collection apertures for collecting foreign matter and (d) the wiper pad being generally ell-shaped having a forward bearer-engageable portion and a rearward mounting portion and means for mounting said mounting portion to the extensible arm.

2. A wiper assembly as defined in claim 1 in which:

(d) the wiper pad is of felt material, the bearer-engageable portion is of substantially uniform thickness and the collection apertures extend completely through said bearer engageable portion.

3. A wiper assembly as defined in claim 2, in which:

(e) the wiper pad mounting means includes a flexible ell-shaped backing plate conforming generally to the configuration of the wiper pad, a clamping frame including a cross member connected to the arm and a clamping screw operatively engageable with the cross member for moving said cross member into clamping relation with the wiper pad and backing plate.

4. A wiper assembly as defined in claim 3, in which:

(f) the wiper pad forward and rearward portions are formed from a single pad of substantially uniform thickness, said pad having a transverse notch and including means for stiffening the pad so that it conforms to the desired ell-shaped configuration.

5. A wiper assembly as defined in claim 4, in which:

(g) the stiffening means is provided by glue spots.

6. In a printing apparatus having rotatable bearer members, a wiper assembly comprising:

(a) a support means, (b) a cylinder means having an extensible piston means mounted therein, one of said means being mounted to the support means, and (c) a bearer-engageable wiper means removably attached to the other of said means, (e) the wiper means including a generally ell-shaped felt wiper pad having a forward bearer-engageable portion including a plurality of collection apertures for collecting foreign matter and a rearward mounting portion and means for mounting the mounting portion to said other of said cylinder means and piston means, the wiper pad mounting means including a flexible ell-shaped backing plate conforming generally to the configuration of the wiper pad and a clamping frame and clamping screw attached to said other of said cylinder means and piston means for clamping the backing plate and the wiper pad mounting portion to said means.

7. A wiper assembly as defined in claim 6, in which:

(f) the collection apertures are of a size and number to provide as aperture ar-a of substantially fourteen percent (14%) of the area of said bearer engageable portion.

* * * * *

UNITED STATES PATENT AND TRADEMARK OFFICE

CERTIFICATE OF CORRECTION

PATENT NO. : 4,893,562

DATED : January 16, 1990

INVENTOR(S) : Albert W. Robertson

It is certified that error appears in the above-identified patent and that said Letters Patent is hereby corrected as shown below:

Column 5, line 47, delete "(180° " and insert --(180°)--

Column 6, line 19, delete "matter and" and insert --matter, and--

Column 6, line 66, delete "as aperture ar-a" and insert --an aperture area--

Signed and Sealed this

Second Day of June, 1992

*Attest:*

DOUGLAS B. COMER

*Attesting Officer*

*Acting Commissioner of Patents and Trademarks*